United States Patent [19]

Hartland

[11] Patent Number: 4,606,543

[45] Date of Patent: Aug. 19, 1986

[54] PRACTICE TENNIS COURT

[76] Inventor: Albert C. Hartland, 1738 Nocturne, Houston, Tex. 77043

[21] Appl. No.: 623,954

[22] Filed: Jun. 25, 1984

Related U.S. Application Data

[63] Continuation-in-part of Ser. No. 302,046, Sep. 14, 1981, Pat. No. 4,456,252.

[51] Int. Cl.[4] ..... A63B 61/00

[52] U.S. Cl. ..... 273/29 A

[58] Field of Search ..... 273/29 A, 29 R, 30, 273/1 R, 176 E, 176 R, 176 FA, 176 G, 31, 105, 181 R, 179 R, 176 K; 272/3, 105 R, 181 R, 176 K; 294/19 A; 124/51 A; 428/132; 414/440

[56] References Cited

U.S. PATENT DOCUMENTS

| | | | |
|---|---|---|---|
| 3,184,239 | 5/1965 | Heuser | 273/176 FA |
| 3,863,922 | 2/1975 | Peeples | 373/176 K |
| 4,116,436 | 9/1978 | Bjorhn | 273/29 R |
| 4,215,865 | 8/1980 | Pilati | 273/176 FA |

*Primary Examiner*—Richard C. Pinkham
*Assistant Examiner*—Ti Brown
*Attorney, Agent, or Firm*—Neal J. Mosely

[57] ABSTRACT

A practice tennis court for practicing serving the tennis balls consists of the complete forward part of a tennis court back to the net and only the service area beyond the net. Behind the service area is an end net or other backstop to stop the balls without rebounding. At the end of the court behind the user, there is a continuous rake extending across the court for sweeping used balls to the back of the service area and beyond where the balls are swept into a trough extending from side to side to discharge the spent balls to a side collection point or through a center collection outlet for discharging balls to a center collection point or to a ball projecting machine. As needed, the rake is moved to sweep the spent balls from the forward portion of the court under the net and across the service end of the court and into the trough for removal. An alternate embodiment uses the same ball collection system on a full size court with a ball projector for practicing ball return. The ball collection rake is driven by a self contained motor which reverses and returns to the starting point after sweeping the balls into the collection trough.

12 Claims, 6 Drawing Figures

PRACTICE TENNIS COURT

CROSS REFERENCE TO RELATED APPLICATIONS

This application is a continuation-in-part of applicant's copending application Ser. No. 302,046, filed Sept. 14, 1981, now U.S. Pat. No. 4,456,252, issued June 26, 1984.

BACKGROUND OF THE INVENTION

1. Field of the Invention

This invention relates to new and useful improvements in practice tennis courts and more particularly to a court having a novel ball rake for collecting balls after practice.

2. Description of the Prior Art

Various types of apparatus and various arrangements of tennis playing facilities have been provided in the past for practicing the game of tennis.

Sawyer U.S. Pat. No. 3,203,696 discloses an apparatus for projecting tennis balls toward a player for use in practicing the game of tennis.

Graves U.S. Pat. No. 3,858,880 discloses a practice tennis range having a common central receiving court and a plurality of individual stroke courts.

Worthington U.S. Pat. No. 3,948,512 discloses a recreational facility incorporating a plurality of tennis courts positioned radially from a common point. There is a slight overlap between adjacent courts using this construction.

Schain U.S. Pat. No. 3,966,205 discloses a practice serving arrangement for tennis which includes a net having a collecting pocket and arranged to be positioned on the opposite end of the court from the person practicing serves.

Hodges U.S. Pat. No. 4,025,071 discloses a tennis ball feeder for use in practicing the game of tennis.

Kreuzman U.S. Pat. No. 4,204,679 discloses a tennis practice serving net which is mounted on wheels and adjustable along a service practice area.

Hartland U.S. Pat. No. 4,456,252 discloses a tennis court specifically designed for service practice and having a ball collection system.

SUMMARY OF THE INVENTION

One of the objects of this invention is to provide an improved arrangement for practicing tennis.

Another object of the invention is to provide an improved arrangement for practicing tennis which has a novel system for collecting and returning the balls used.

A further object of the invention is to provide an improved practice tennis court and ball collection system which sweeps the entire length of the court.

Other objects of this invention will become apparent from time to time throughout the specification and claims as hereinafter related.

These and other objects of this invention are accomplished by a practice tennis court for practicing serving the tennis balls which consists of the complete forward part of a tennis court back to the net and only the service area beyond the net. Behind the service area is an end net or other backstop to stop the balls without rebounding. At the end of the court behind the user, there is a continuous rake extending across the court for sweeping used balls to the back of the service area and beyond where the balls are swept into a trough extending from side to side to discharge the spent balls to a side collection point or through a center collection outlet for discharging balls to a center collection point or to a ball projecting machine. As needed, the rake is moved to sweep the spent balls from the forward portion of the court under the net and across the service end of the court and into the trough for removal. An alternate embodiment uses the same ball collection system on a full size court for use with a ball projector for practicing ball return. The ball collection rake is driven by a self contained motor which reverses and returns to the starting point after sweeping the balls into the collection trough.

DESCRIPTION OF THE PREFERRED EMBODIMENT

Figure 1:
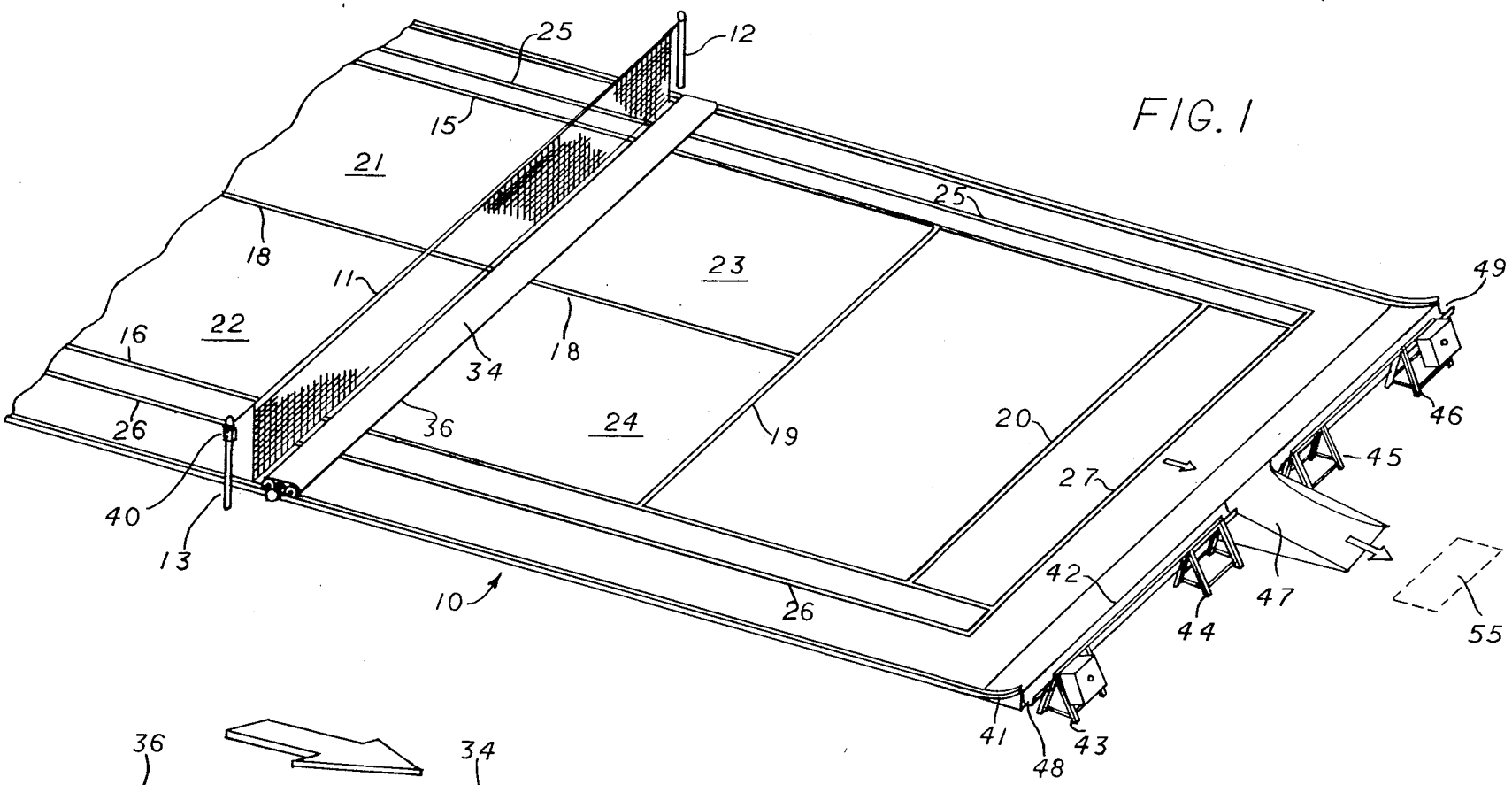
FIG. 1 is an isometric view of the rear end of a practice tennis court illustrating a ball rack and collection system representing a preferred embodiment of the invention.
Figure 3:
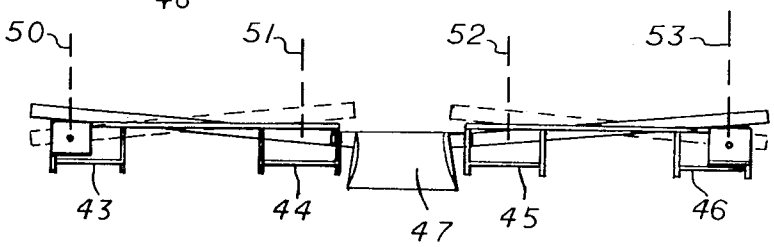
FIG. 3 is a somewhat diagrammatic end view of the ball collection trough illustrating the operation of the trough to empty balls to the center rear or to the sides.

In the drawings, there is shown a practice tennis court for practicing serving and returning a tennis ball. The service-only court and associated apparatus which is shown in FIG. 5 is designed for installation in office buildings or the like to provide an area for recreation and exercise. This practice court can also be installed in specially designed recreational areas outside or in recreational buildings or enclosures. This embodiment is at least partially shown in copending U.S. patent application Ser. No. 302,046, now U.S. Pat. No. 4,456,252. The full size court shown in FIG. 4 illustrates the application of the ball collection system to an existing, full-size tennis court.

Referring to the drawings, and more particularly to FIG. 1, there is shown an embodiment of this invention which consists of a practice tennis court 10 which is specially designed for tennis practice, particularly serving the ball. Practice court 10 is laid out on any suitable playing surface and has a conventional tennis net 11 supported between vertically extending posts 12 and 13.

Figure 4:
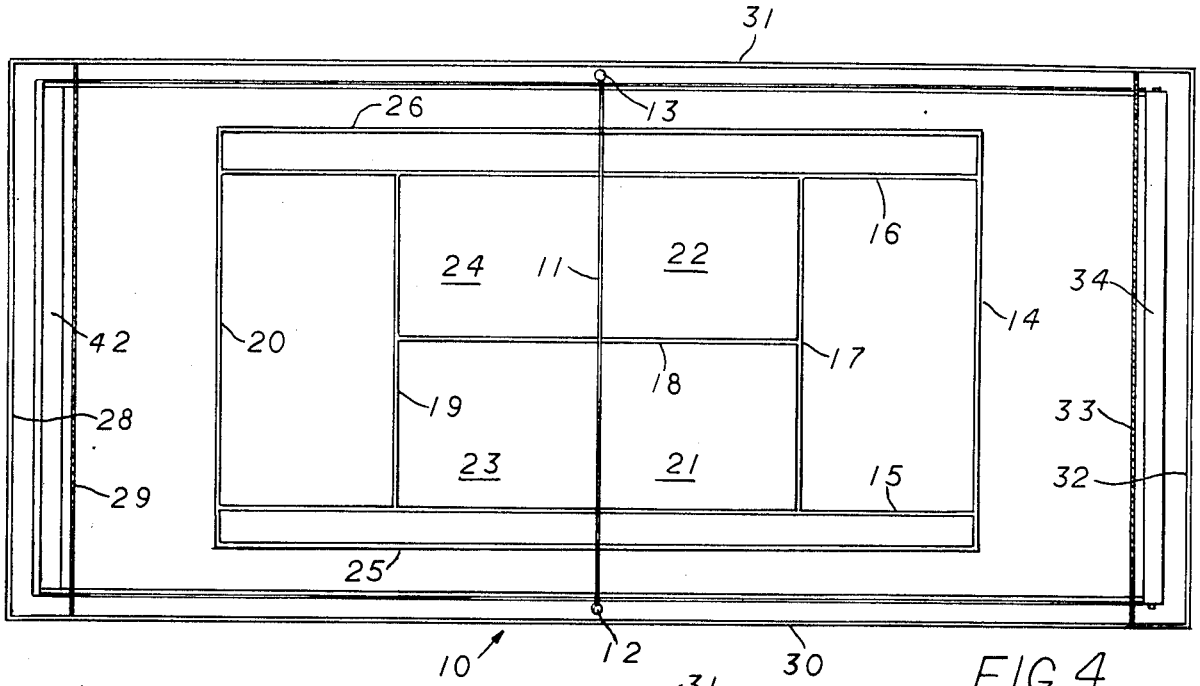
FIG. 4 is a plan view of a full size tennis court with the ball collection system installed.
Figure 5:
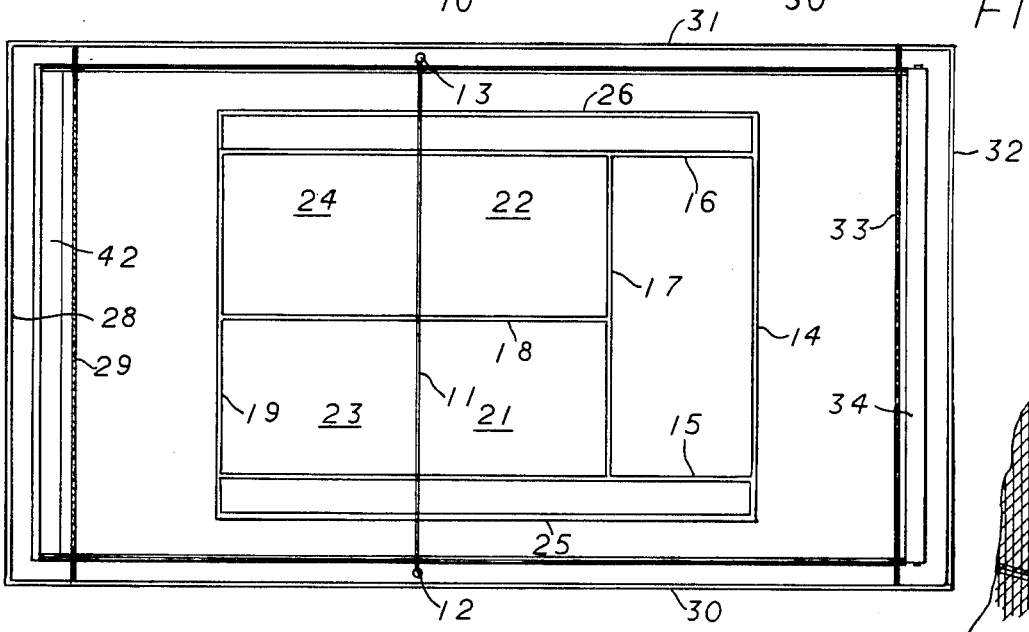
FIG. 5 is a plan view of a service-only practice tennis court with the ball collection system installed.
Figure 6:
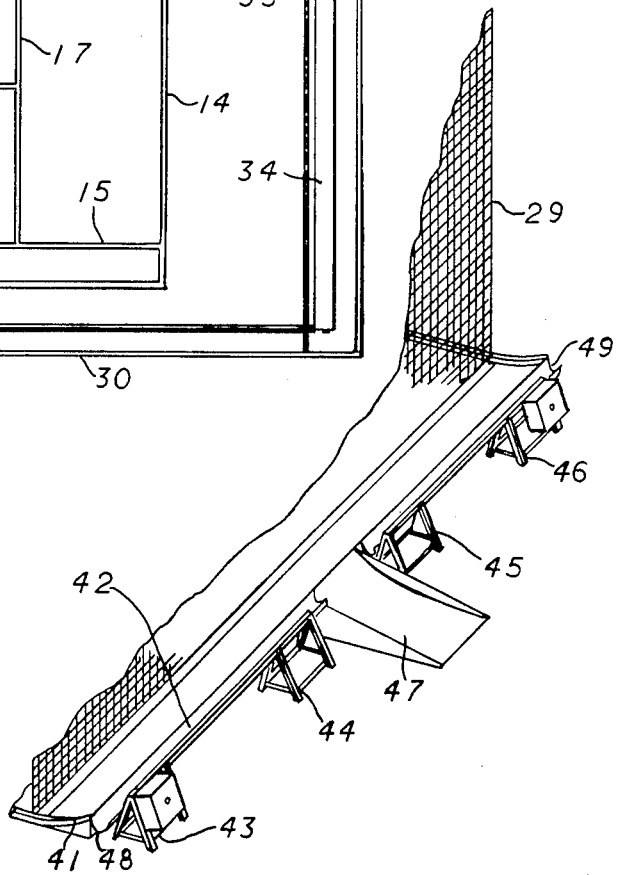
FIG. 6 is a detail view of the end of the courts shown in FIGS. 4 and 5 illustrating the ball stopping and collection system.

The front part of practice court 10, extending to the left of net 11 in FIG. 1, consists of one half, viz. the receiving half, of a regulation tennis court and is shown more fully in FIG. 4. This one half court has a base line 14 and side lines 15 and 16 which define the boundaries of the court. A service line 17 is positioned at the regulation distance. A center dividing line 18 extends from the mid point of service court line 17 past net 11 to the far end of the practice area.

In a full-size complete court, as in FIGS. 1 and 5, end of practice court 10 beyond the net 11 consists of a full regulation size court having a service court line 19 and a rear receiving line 20. The service area extending from net 11 to service court line 19 is divided into the normal service areas by center line 18.

In a service-only, practice court, as shown in FIG. 5, the end of practice court 10 beyond the net 11 consists of a partial court extending only to the service court line 19. The area of the court 10 (in FIG. 5) from the service line 19 to the rear receiving line 20 is omitted. The service area extending from net 11 to service court line 19 is divided into the normal service areas by center line 18. The courts as shown in FIGS. 4 and 5 each consists of a left hand inner service area 21 and a right hand inner service area 22; and a left hand outer service area 23 and a right hand outer service area 24. The outer, doubles lines 25, 26 and 27 are shown in FIG. 1 but not in FIGS. 4 and 5. The court may be installed on a full size court, as in FIG. 1 or may be installed for singles play as shown in FIGS. 4 and 5.

At the rear of practice court 10, beyond the outer service areas 22 and 23, there may be provided a suitable vertical wall 28. A net 29 is hung a short distance in front of wall 38 by suitable means. Net 25 is supported about ten inches above the surface of the court and suitably spaced from rear wall 28. The end net is preferably about eight feet high to provide a surface for catching spent balls and to prevent their rebounding back into the playing area.

The left hand limit of court 10 is defined by left side line 30 and the right hand limit by right side line 31. Side lines 30 and 31 extend back to the rear boundary line. Supporting posts 12 and 13 are positioned at the side lines 30 and 31.

At the rear end of the court, 10 there is a wall 32 with a net 33 hanging in spaced relation thereto. A moveable rake 34 is positioned in a concealed position behind the net 33 and extends from side to side across the entire width of practice court 10. Rake 30 is of a height such that it may pass under the lower end of net 29 and 33. Also, the playing net 11 will usually be left loose at the bottom to permit the rake 34 to pass under it when the court is being used with these practice accessories. When the court (FIGS. 1 and 4) is used for regulation play, the net 11 will be tied down as required by regulations.

Figure 2:
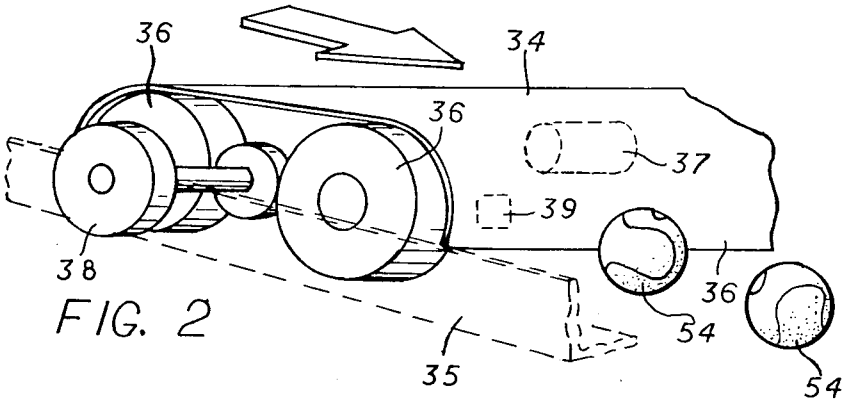
FIG. 2 is a detail isometric view illustrating the ball-collecting rake and system shown in FIG. 1.

Rake 34 is shown in more detail in FIGS. 1 and 2. A pair of tracks 35 are positioned one along each of the sidelines 30 and 31. Rake 34 comprises a housing 36 of inverted U-shaped cross section which extends from side to side across the court and has a plurality of wheels at each end which are driven and guided along the tracks 35. The inner wheels 36 are driven by an electric motor 37 (shown schematically in FIG. 2) which may be energized by an extension cord or by an electrical connection through the track (not shown). Wheels 38 are located outside the tracks 35 to secure and guide the rake 34 for movement thereon. A reversing switch 39 is shown schematically on housing 36. On actuation by a control switch 40 (FIG. 1), the motor 37 is operable to drive the rake 34 along the entire length of the court to sweep the balls from both the receiving area and the service areas to the rear of the court for collection.

At the rear of the practice court, behind net 29, there is provided an inclined ramp 41 which extends to a collection trough 42. Trough 42 extends laterally or transversely of the practice court and is operable to collect spent balls and move the same to a suitable container or reservoir (not shown). Trough 42 is supported on a plurality of supports, preferably A-frames 43, 44, 45 and 46. Trough 41 may be divided into two separate parts with a rear opening discharge 47 and open ends 48 and 49. Lifting means 50, 51, 52 and 53 are provided for tilting the trough sections to discharge the collected balls therefrom. The lifting means 50–53 are shown schematically and may be hydraulic lifts, mechanically operated cables or the like.

USE OF PRACTICE COURT

Practice court 10, as described above, is used for the purpose of practicing serving or returning the ball at the game of tennis. The near or forward half of the practice court corresponds exactly to the serving end of a regulation court. A player who is using practice court 10 of FIG. 5 will stand at the normal position at the base line and practice serving balls 54 over net 11 into service area 22 or 23, depending upon the position from which service is begun. This practice court is used for practicing the service of the tennis balls 54 in the same manner as practice would be carried out on a regulation court. The balls which clear net 11 and pass into service areas 23 or 24 may rebound against net 29 and fall to the surface of the court. Also, some of the balls used in practice may rebound somewhat into the serving areas.

The player practicing in this court would ordinarily be given a selected number of the balls 54 for practice at a suitable charge made for the use of the balls. When the player has completed serving the balls, it is necessary to have the balls collected and returned to a suitable collection point. The balls which have struck net 25 and fall to the surface are swept to the collection trough by the rake 34 as will be subsequently described.

When the court 10 is used for practicing the return of the tennis ball, the full-size court is used as in FIG. 4. Also, a ball projector 55 is provided at the rear of the trough 42, shown schematically in FIG. 1. Ball projector 55 projects the balls 54 to the receiving end of the court for the player to return. The player practicing in this court would ordinarily be given a selected number of the balls 54 for practice at a suitable charge made for the use of the balls. When the player has completed practicing with the balls, it is necessary to have the balls collected and returned to a suitable collection point. The balls which have fallen on the surface are swept to the collection trough by the rake 34 as will be described below.

When the balls 54 are to be collected, the control switch 40 is actuated to energize motor 37 to move rake 34 along the track 35. Rake 34 sweeps the balls 54 along the entire length of the current and up the inclined surface 41 and into trough 42 for collection and discharge. At that point, the reversing switch 39 causes motor 37 to reverse and move the rake 34 back to its initial position behind the net 33.

When the full size court and ball projector are used, the actuators 50 and 53 are operated to lift the outer ends of the segments of trough 42 to cause the balls to roll to the center and out through the outlet 47 to the ball projector 55. When the service practice court of FIG. 5 is used, the actuators 51 and 52 are operated to lift the inner ends of the segments of trough 42 to cause the balls to roll to the outside to discharge through open ends 48 and 49 into collection buckets or the like (not shown).

While this invention has been described fully and completely with emphasis upon two preferred embodiments it should be understood that within the scope of the appended claims the invention may be practiced otherwise than as specifically described herein.

I claim:

1. A practice court for tennis comprising a flat surface marked with lines defining at least a portion of a regulation tennis court, supporting posts and a tennis net supported therebetween on said surface, said lines including longitudinally and transversely extending lines defining the complete front or receiving half of a regulation tennis court in front of said posts and net and including at least the lines of defining the sidelines and the service line defining the service area of the court beyond said posts and net, and in combination therewith means to collect and recover spent practice tennis balls comprising a wheeled rake extending over the entire width of said court and between said support posts for said net and reversible motor means supported thereon and operatively connected to said wheels, said rake having an initial position behind the user at the front or receiving end of the court and movable by said reversible motor means over the entire length of the court under the playing net to an end point a predetermined distance beyond said service area and back to said initial position, and a trough adjacent to said end point of movement of said rake means to receive said balls for discharge to a predetermined discharge point.

2. A tennis practice court according to claim 1 in which said surface is marked with lines defining an entire regulation tennis court and said initial position of said rake means is outside the receiving end of said court and said end point of movement of said rake means is outside the service end of said court.

3. A tennis practice court according to claim 1 in which said surface is marked with lines defining a service practice court comprising the entire receiving end of a regulation court, the net, and the service area only of a regulation court, and said initial position of said rake means is outside the receiving end of said court and said end point of movement of said rake means is outside the service area of said court but inside the regulation length of said court.

4. A tennis practice court according to claim 1 in which said reversible motor means includes means to reverse the operation thereof at said end point of movement.

5. The tennis practice court according to claim 1 in which said rake means includes a track guiding the movement of said wheeled rake from said initial position to said end point of movement and return, and said reversible motor means includes means to reverse the operation thereof at said end point of movement.

6. A tennis practice court according to claim 1 in which said rake means includes a pair of tracks extending in parallel relation to and outside the sidelines of said court and between the supporting posts for said net, a wheeled rake extending for the entire width of said court and between the net posts comprising a housing extending the entire length thereof and having a wall portion extending adjacent to the surface to provide a surface engageable with balls to sweep the same along the court, a plurality of wheels at each end of said housing positioned on opposite sides of each track for guiding movement of said rake, and a reversible motor supported in said housing and operatively connected to said wheels for moving said rake from said initial position to said end point of movement and return.

7. A tennis practice court according to claim 6 in which said reversible motor includes means to reverse the operation thereof at said end point of movement.

8. A practice court for tennis comprising a flat surface marked with lines defining at least a portion of a regulation tennis court, supporting posts and a tennis net supported therebetween on said surface, said lines including longitudinally and transversely extending lines defining the complete front or receiving half of a regulation tennis court in front of said posts and net and including at least the lines defining the sidelines and the service line defining the service area of the court beyond said posts and net, and in combination therewith means to collect and recover spent practice tennis balls comprising a wheeled rake extending over the entire width of said court and between said net posts and reversible motor means supported thereon and operatively connected to said wheels, said rake having an initial position behind the user at the front or receiving end of the court and movable by said reversible motor means over the entire length of the court and under the playing net to an end point a predetermined distance beyond said service area and back to said initial position, a trough adjacent to said end point of movement of said rake means to receive said balls for discharge to a predetermined discharge point, said trough being positioned above the level of said surface in a substantially level position and an inclined surface connects said surface to said trough at said end point of movement.

9. A tennis practice court according to claim 8 including means to tilt said trough in a selected direction for discharging balls collected therein.

10. A tennis practice court according to claim 9 in which said trough is open at one end and said tilting means tilts said trough in the direction of said open end.

11. A tennis practice court according to claim 9 in which said court includes ball collecting means at the center of said trough, said trough has a center rear opening, and said tilting means is operable to tile the ends of said trough toward the center to discharge balls through said center rear opening.

12. A tennis practice court according to claim 9 in which said trough includes a supporting frame supporting the same across said surface beyond said service area, said tilting means comprises fluid actuated means for elevating a selected portion of said frame.

* * * * *